US009162136B1

(12) United States Patent
Towns

(10) Patent No.: US 9,162,136 B1
(45) Date of Patent: Oct. 20, 2015

(54) OUTDOOR KICKBALL BILLIARDS GAMING APPARATUS

(71) Applicant: Dwayne Towns, Flint, MI (US)

(72) Inventor: Dwayne Towns, Flint, MI (US)

( * ) Notice: Subject to any disclaimer, the term of this patent is extended or adjusted under 35 U.S.C. 154(b) by 141 days.

(21) Appl. No.: 13/919,637

(22) Filed: Jun. 17, 2013

(51) Int. Cl.
*A63D 15/00* (2006.01)
*A63D 15/06* (2006.01)

(52) U.S. Cl.
CPC ..... *A63D 15/00* (2013.01); *A63D 15/003* (2013.01); *A63D 15/06* (2013.01)

(58) Field of Classification Search
CPC ..... A63B 67/04; A63B 67/02; A63D 15/00; A63D 15/02
USPC ..... 473/1, 3, 10, 4, 18, 31, 471, 560, 157, 473/160, 171; 273/108.21, 123 R
See application file for complete search history.

(56) References Cited

U.S. PATENT DOCUMENTS

| | | | | | |
|---|---|---|---|---|---|
| 278,341 | A | * | 5/1883 | Kelly | 473/3 |
| 302,196 | A | * | 7/1884 | Eulass | 473/13 |
| 704,892 | A | * | 7/1902 | Lowerre | 473/8 |
| 1,255,542 | A | * | 2/1918 | Le Cour | 473/13 |
| 1,670,608 | A | | 5/1928 | Christoph | |
| 1,679,659 | A | | 8/1928 | Hasskarl et al. | |
| 1,813,116 | A | * | 7/1931 | Clausen | 473/20 |
| 2,014,788 | A | * | 9/1935 | Strickler et al. | 473/3 |
| 2,827,299 | A | * | 3/1958 | Dean | 473/158 |
| 3,138,387 | A | * | 6/1964 | Michel et al. | 473/159 |
| 3,591,176 | A | * | 7/1971 | Roth | 473/3 |
| 3,715,123 | A | * | 2/1973 | Baum | 473/159 |
| 3,871,650 | A | * | 3/1975 | Casey | 473/171 |
| 4,229,004 | A | * | 10/1980 | Stokes | 473/3 |
| 4,284,277 | A | * | 8/1981 | Leonard et al. | 473/471 |
| 4,336,936 | A | * | 6/1982 | Young | 473/15 |
| 4,544,156 | A | * | 10/1985 | Rasmussen et al. | 473/13 |
| 4,575,078 | A | * | 3/1986 | Fogarty et al. | 473/32 |
| 4,875,680 | A | * | 10/1989 | Gross | 473/14 |
| 4,957,288 | A | * | 9/1990 | Kantner et al. | 473/3 |
| 4,989,863 | A | * | 2/1991 | Hall | 473/15 |
| 5,116,048 | A | * | 5/1992 | Bilocerkowycz et al. | 473/3 |
| D347,026 | S | * | 5/1994 | Young | D21/318 |
| 5,735,749 | A | * | 4/1998 | Charbel et al. | 473/3 |
| 5,765,828 | A | * | 6/1998 | Baker et al. | 473/18 |
| 5,833,546 | A | * | 11/1998 | Wang | 473/3 |
| 6,168,533 | B1 | * | 1/2001 | Camara | 473/3 |
| D480,775 | S | * | 10/2003 | Fischer | D21/782 |
| 6,780,117 | B1 | * | 8/2004 | Osborne | 473/10 |

(Continued)

FOREIGN PATENT DOCUMENTS

| | | | | |
|---|---|---|---|---|
| WO | WO 9011807 | * | 10/1990 | A63D 15/00 |

*Primary Examiner* — Mitra Aryanpour
(74) *Attorney, Agent, or Firm* — Crossley Patent Law

(57) ABSTRACT

An outdoor kickball billiards gaming apparatus including a perimetric frame erectable atop a border of a rectangular polymeric mat, said frame thereby enclosing an area of game-play, said frame including a plurality of polymeric cushions thereupon disposed within the area of game-play, said frame interconnected at each corner by each of a plurality of corner pockets interconnectable cornerwise into the frame, and a pair of side pockets interconnectable medially into the frame oppositely disposed across a tangential axis of said frame, wherein each of a plurality of balls, voluble upon the polymeric mat, is directable into each of the respective corner and side pockets, whereby a cue ball is kickable to impact each of a plurality of game balls for capture within each of the plurality of corner and alternately side pockets, and a game of outdoor kickball billiards is playable thereby.

6 Claims, 4 Drawing Sheets

(56) References Cited

U.S. PATENT DOCUMENTS 6,846,243 B2 * 1/2005 Francisco ..... 473/3
6,872,147 B2 * 3/2005 Shih ..... 473/15
6,893,017 B1 * 5/2005 Thomas et al. ..... 473/1
8,550,929 B1 * 10/2013 Nebauer-McRae ..... 473/15
2008/0261710 A1 * 10/2008 Ruelle ..... 473/10

* cited by examiner

OUTDOOR KICKBALL BILLIARDS GAMING APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of outdoor billiards gaming apparatuses are known in the prior art. However, what is needed is an outdoor kickball billiards gaming apparatus that includes a perimetric frame erectable atop a border of a rectangular polymeric mat, said frame thereby enclosing an area of game-play, said frame including a plurality of polymeric cushions thereupon, each of said cushions disposed within the area of game-play, said frame interconnected at each corner by each of a plurality of corner pockets interconnectable cornerwise into the frame, and a pair of side pockets interconnectable medially into the frame oppositely disposed across a tangential axis of said frame, wherein each of a plurality of balls, voluble upon the polymeric mat, is directable into each of the respective corner and side pockets, whereby a cue ball is kickable to impact each of a plurality of game balls for capture within each of the plurality of corner and alternately side pockets, and a game of outdoor kickball billiards is playable thereby.

FIELD OF THE INVENTION

The present invention relates to an outdoor kickball billiards gaming apparatus, and more particularly, to an outdoor kickball billiards gaming apparatus that includes a perimetric frame erectable atop a border of a rectangular polymeric mat, said frame thereby enclosing an area of game-play, said frame including a plurality of polymeric cushions thereupon, each of said cushions disposed within the area of game-play, said frame interconnected at each corner by each of a plurality of corner pockets interconnectable cornerwise into the frame, and a pair of side pockets interconnectable medially into the frame oppositely disposed across a tangential axis of said frame, wherein each of a plurality of balls, voluble upon the polymeric mat, is directable into each of the respective corner and side pockets, whereby a cue ball is kickable to impact each of a plurality of game balls for capture within each of the plurality of corner and alternately side pockets, and a game of outdoor kickball billiards is playable thereby.

SUMMARY OF THE INVENTION

The general purpose of the outdoor kickball billiards gaming apparatus, described subsequently in greater detail, is to provide an outdoor kickball billiards gaming apparatus which has many novel features that result in an outdoor kickball billiards gaming apparatus which is not anticipated, rendered obvious, suggested, or even implied by prior art, either alone or in combination thereof.

The present outdoor kickball billiards gaming apparatus enables an outdoor kickball billiards game upon a suitable ground surface. The word "kickball", as used herein, is taken to mean a game where a cue ball is directed by the feet of a player to impact each of a plurality of game balls, and thereby direct each of said plurality of game balls into a respective pocket for capture and scoring therein.

The present outdoor kickball billiards gaming apparatus, therefore, includes a rectangular polymeric mat. A hook and loop border is disposed perimetrically around the mat and a plurality of holes are disposed in the border for attachment of an overlying, erectable perimetric frame.

The perimetric frame includes a plurality of right-triangular prism members. Each of the right-triangular prism members includes a hook and loop fastener disposed to contact the hook and loop border disposed atop the mat. A plurality of vertical spikes are disposed upon each right-triangular prism member for insertion through each of the plurality of holes disposed upon the mat border. Thus, the perimetric frame is securable atop the mat to enclose an area of game-play.

The perimetric frame maintains the mat tautly between the right-triangular prism members and upon a relevant ground surface, whereby impacts against the frame are prevented from moving the frame and the mat is likewise prevented from riling during game-play thereupon.

The perimetric frame includes a plurality of polymeric cushions disposed thereupon overlying the area of game-play. Each of said plurality of cushions is a perfect triangular prism disposed with an apex normal the frame and overlying the area of game-play. When each of the plurality of balls impacts a respective cushion, therefore, said ball is caromed in a manner similar to that evinced in tabletop billiards, as known in the art.

The perimetric frame is interconnected at each corner by means of each of a plurality of corner pockets. Each of the plurality of corner pockets is interconnectable into the frame and joins two adjacent perpendicular sides of the frame together. Each of the plurality of corner pockets includes an arch section, springing over an aperture, and a mesh pocket disposed enclosing the aperture outside the frame for capture of balls therein.

The perimetric frame is also interconnected at a pair of corner pockets. Each of the pair of corner pockets is disposed within the frame on opposite sides of a medial, tangential axis of the frame. Each corner pocket likewise includes an arch section springing over an aperture and, also, a mesh pocket disposed enclosing the aperture outside the frame for capture of balls therein.

The plurality of balls includes a cue ball and a plurality of game balls. Each of the plurality of balls includes a polymeric outer surface and a rubberized interior. In the preferred embodiment herein disclosed, each of the plurality of balls is contemplated to be oversized relative typical billiard balls seen in the art. The cue ball is thus kickable by a player without injury to the foot, and each of the plurality of balls is sized appropriate to be voluble through each aperture disposed at each of the corner and side pockets, respectively.

To setup the game for initial play, a foldable rack is included. The rack is moveable from a folded position to a triangular situation, wherein the plurality of game balls may be racked appropriately for a break by a starting player.

Thus has been broadly outlined the more important features of the present outdoor kickball billiards gaming apparatus so that the detailed description thereof that follows may be better understood and in order that the present contribution to the art may be better appreciated.

Objects of the present outdoor kickball billiards gaming apparatus, along with various novel features that characterize the invention are particularly pointed out in the claims forming a part of this disclosure. For better understanding of the outdoor kickball billiards gaming apparatus, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
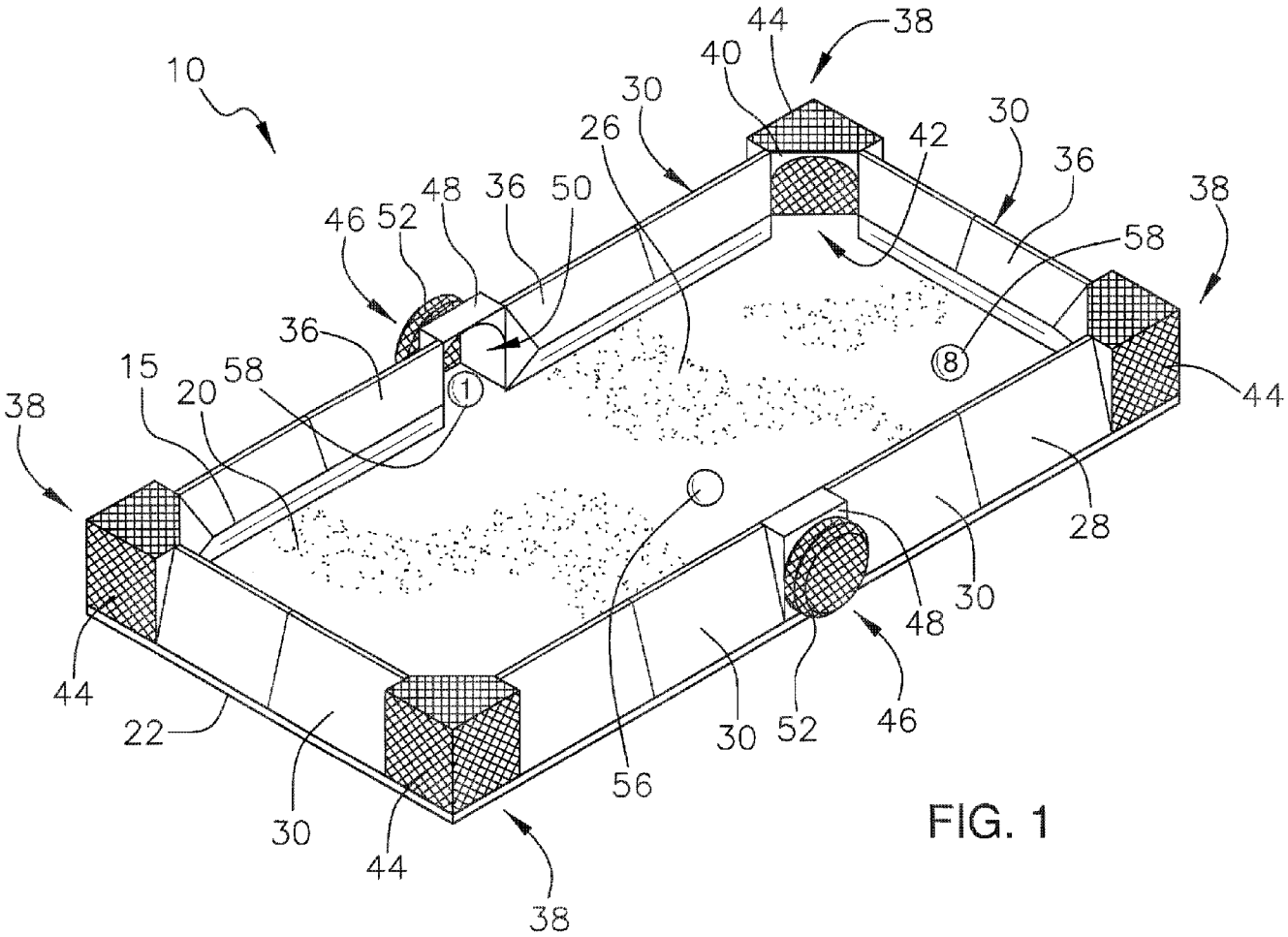
FIG. 1 is an isometric view of an embodiment.
Figure 2:
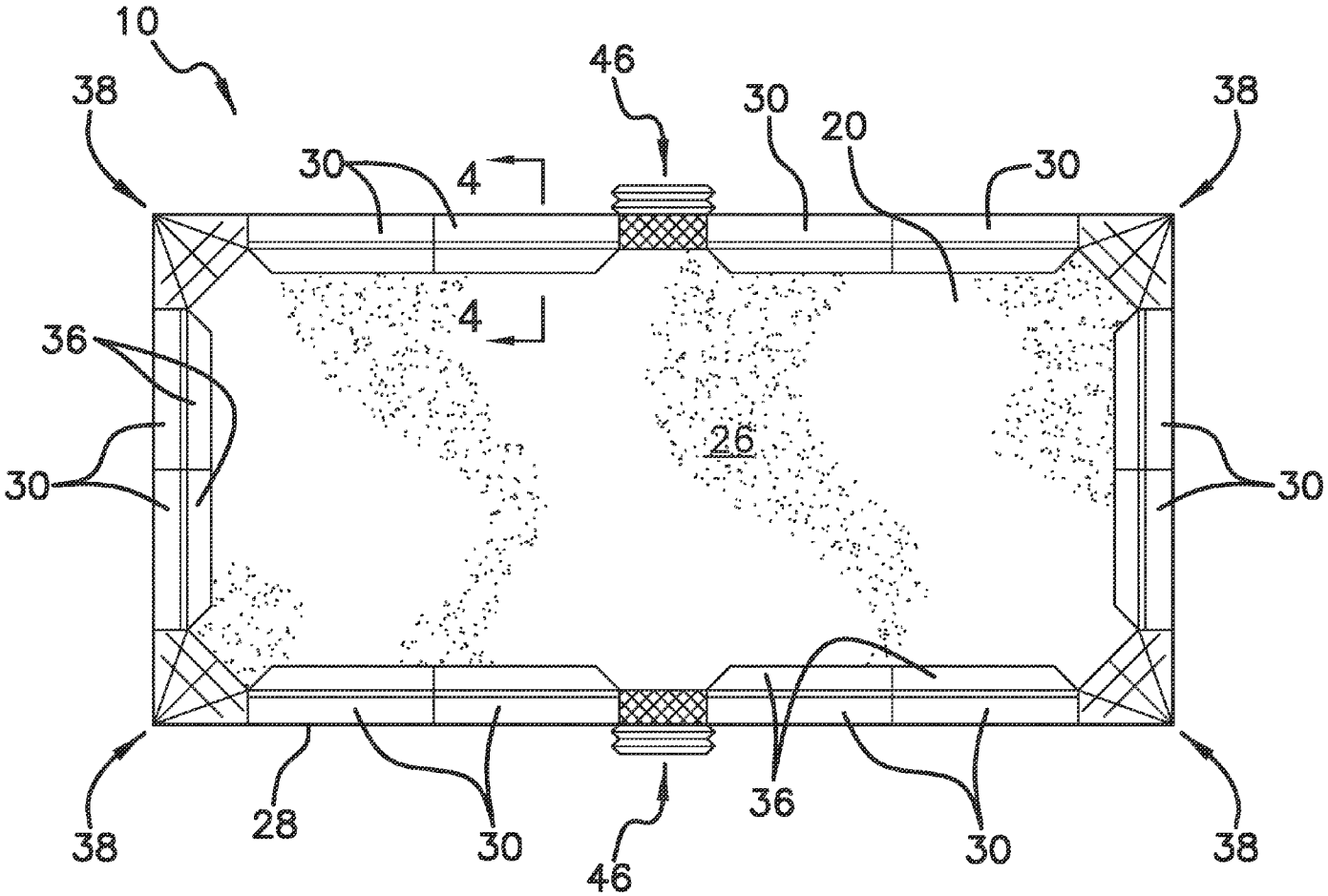
FIG. 2 is a top view of an embodiment.
Figure 3:
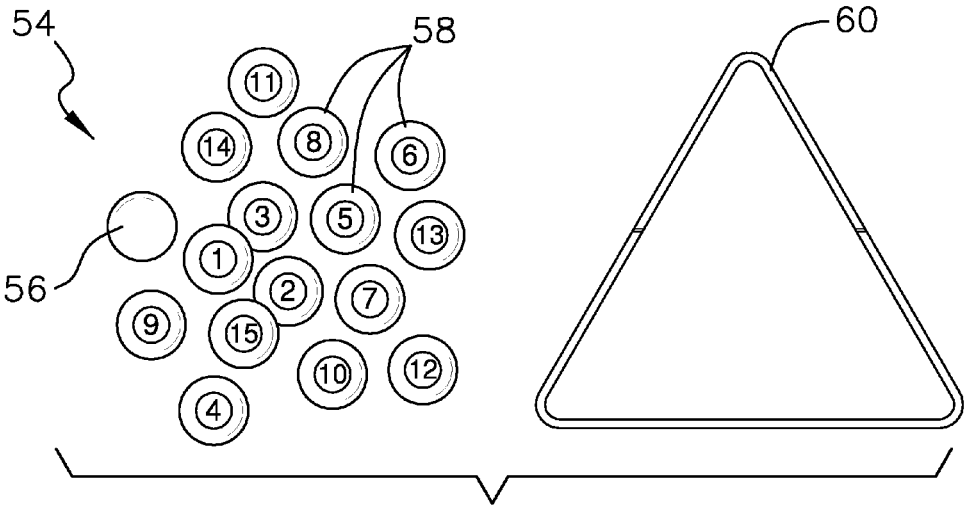
FIG. 3 is a top view of a plurality of balls and a foldable rack.
Figure 4:
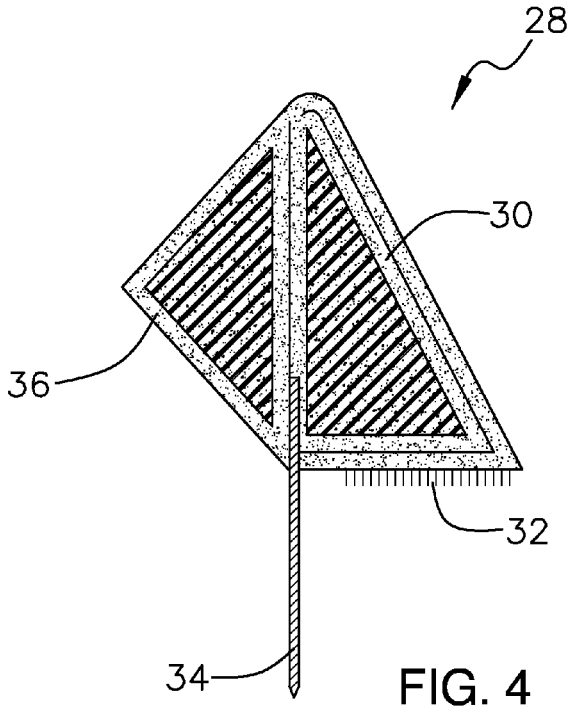
FIG. 4 is a cross-section view of a right-triangular prism member of an erectable perimetric frame.
Figure 5:
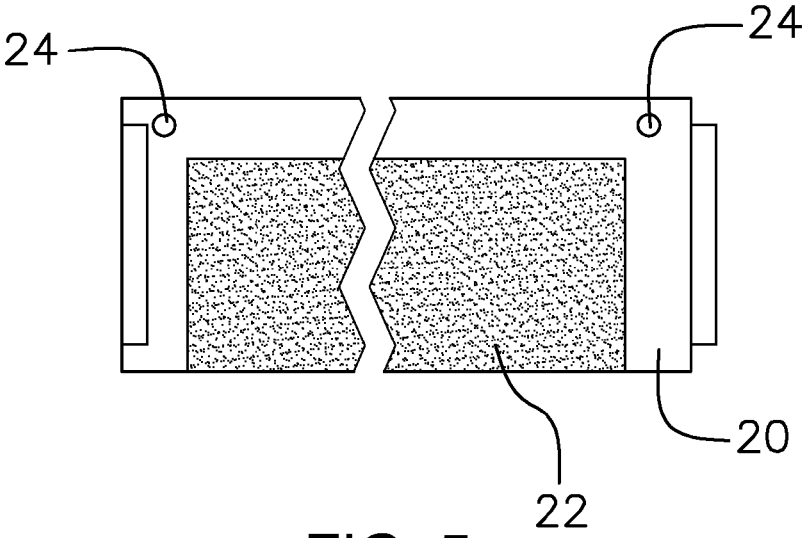
FIG. 5 is a top view of a portion of a border of a mat.
Figure 6:
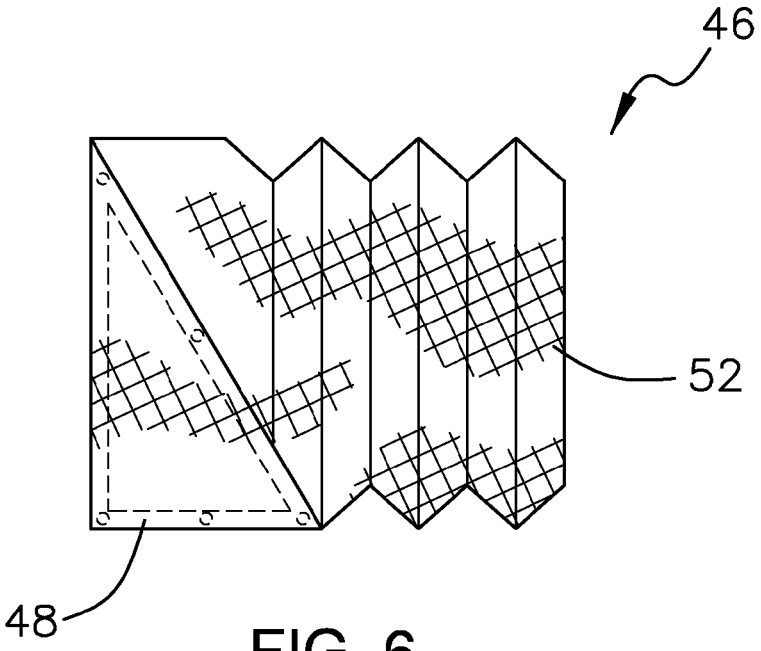
FIG. 6 is a side view of a side pocket.

With reference now to the drawings, and in particular FIGS. 1 through 6 thereof, example of the instant outdoor kickball billiards gaming apparatus employing the principles and concepts of the present outdoor kickball billiards gaming apparatus and generally designated by the reference number 10 will be described.

Referring to FIGS. 1 through 6 a preferred embodiment of the present outdoor kickball billiards gaming apparatus 10 is illustrated.

The present outdoor kickball billiards apparatus 10 has been devised to enable an outdoor kickball billiards game. The term "kickball", as used herein, is taken to mean a game wherein a cue ball 56 is struck with a foot of a player to impact each of a plurality of game balls 58. A player, using his feet, thus attempts to direct the cue ball 56 to impact each game ball 58 towards each of a respective pocket 38, 46 interconnected with a perimetric frame 28, said frame 28 disposed enclosing an area of game-play, for capture and scoring within each of said respective pockets 38, 46, as will be described subsequently.

The outdoor kickball billiards gaming apparatus 10, therefore, includes a rectangular polymeric mat 20 having a hook and loop border 22 disposed thereatop, and a plurality of holes 24 disposed around said border 22. A faux-grass surface 26 is disposed atop the mat 20 within the border 22, upon which surface 26 the game of outdoor kickball billiards is played.

A perimetric frame 28, erectable to enclose the mat 20, includes a plurality of right-triangular prism members 30 longitudinally connectable around the mat 20 perimeter to enclose an area of game-play. Each of said right-triangular prism members 30 includes a hook and loop fastener 32 disposed to contact the hook and loop border disposed upon the mat, whereby the frame is secured into position upon the border of the mat, surrounding the area of game-play.

To further secure the frame 28 in position, a plurality of spikes 34 is vertically disposed upon each right-triangular prism member 30. Each of said spikes 34 is configured to insert through each hole 24 disposed on the mat 20 border 22, when the frame 28 is erected into position atop the mat 20 border 22, and secure the frame 28 atop the mat 20 border 22 into an underlying ground surface. The perimetric frame 28 thus secures the mat 20 in a taught position maintained between each right-triangular prism member 30, and thereby secures the mat 20 in position atop an underlying ground surface. Impacts of each of a plurality of balls 54 kicked against the frame 28, then, are prevented from moving the frame 28, or riling the mat 20.

To enable caroming of balls 54 off the frame 28, as is typical in a game of billiards, a plurality of polymeric cushions 36 is disposed upon the frame 28 overlying the area of game-play. Each of the plurality of polymeric cushions 36 is a perfect triangular prism disposed longitudinally upon each right-triangular prism member 30, each cushion 36 presenting an apex 15 normal the frame 28 and overlying the area of game-play. The apex 15 of each cushion 36 normal the frame 28 is structured to better corral the balls 54 within the frame 28 and to assist in preventing the balls 54 from accidentally being elected over the frame 28. Balls 54 struck against each cushion 36, therefore, are caromed around the area of game-play.

Each of a plurality of corner pockets 38 is disposed to connect into the frame 28 at each of four corners. Each corner pocket 38 thus imposes into the frame 28 and connects adjacent right-triangular prism members 30 perpendicularly together. Each of said corner pockets 38 includes an arched section 40 springing atop an aperture 42. The aperture 42 is encapsulated by a mesh pocket 44 disposed outlying the frame 28, to catch balls 54 directed through the aperture 42 from the area of game-play.

A pair of side pockets 46 is also included, each of said side pockets 46 disposed to connect into the frame 28 across a medial, tangential axis of the erected frame 28. Each of said side pockets 46 likewise includes an arch section 48 springing atop an aperture 50. Each aperture 50 of each side pocket 46 is also encapsulated by a mesh pocket 52, disposed outlying the frame 28, to capture balls 54 directed into each respective side pocket 46 during game-play.

The plurality of balls 54 used in the outdoor kickball billiards game includes a cue ball 56 and a plurality of game balls 58, each of said plurality of balls 54 comprising a polymeric outer surface and a rubberized interior. Each of the plurality of balls 54 is oversized relative billiard balls used in extant tabletop games, and is configured to be struck by the foot of a player during game-play. Each of the plurality of balls 54 is sized to fit through each aperture 42, 50 for capture in each of the respective corner 38 and side 46 pockets.

To setup the outdoor kickball billiards game for initial play, a triangular foldable rack 60 is included, said rack 60 erectable from a folded position into a triangular situation common of billiards racks, thereby usable to rack the plurality of game balls 54 atop the area of game-play for breaking with the cue ball 56, in like manner as practiced in the tabletop version of the well known game. Of course, in the present outdoor kickball billiards gaming apparatus 10, no cues are required, each player instead using his or her feet.

Thus, the present outdoor kickball billiards gaming apparatus 10 enables a game of outdoor kickball billiards to be played, whereby a cue ball 56 is struck with a foot of a player in attempts to direct each of the plurality of game balls 58 across the area of game-play towards a respective one of the plurality of pockets 38, 46 for capture, and scoring, therein.

What is claimed is:

1. An outdoor kickball billiards gaming apparatus comprising a perimetric frame erectable atop a border of a rectangular polymeric mat, said frame thereby enclosing an area of game-play, said frame including a plurality of polymeric cushions thereupon and a plurality of interconnectable right-triangular prism members, each of said cushions is a perfect triangular prism disposed longitudinally upon each right-triangular prism member, each cushion presenting an apex normal the frame and overlying the area of game-play, wherein the apex of each cushion enables corralling of each of the plurality of balls impacting said respective cushion, said frame interconnected at each corner by each of a plurality of corner pockets interconnectable cornerwise into the frame, and a pair of side pockets interconnectable medially into the frame oppositely disposed across a tangential axis of said frame, wherein each of the plurality of corner pockets and each of the pair of side pockets comprises an arch section vertically disposed atop an aperture and a mesh pocket disposed outlying the frame encapsulating each of the plurality of corner pockets and each of the pair of side pockets for capture of each of the plurality of balls therein, wherein each of the plurality of balls, voluble upon the polymeric mat, is directable into each of the respective corner and side pockets subsequent impact, whereby a cue ball is kickable to impact each of a plurality of game balls for capture within each of the plurality of corner and alternately side pockets respectively, and a game of outdoor kickball billiards is playable thereby.

2. The outdoor kickball billiards gaming apparatus of claim 1 wherein the mat further comprises a hook and loop border disposed atop the mat, and a plurality of holes disposed within said border.

3. The outdoor kickball billiards gaming apparatus of claim 2 wherein each of said right-triangular prism members includes a hook and loop fastener disposed to contact the hook and loop border disposed upon the mat.

4. The outdoor kickball billiards gaming apparatus of claim 3 wherein each of the frame right-triangular prism members includes a plurality of vertical spikes disposed to insert through each of the plurality of holes disposed in the mat border, wherein the mat is secured tautly between the frame and upon and underlying ground surface.

5. The outdoor kickball billiards gaming apparatus of claim 4 wherein each of the plurality of balls includes a polymeric outer surface and a rubberized interior.

6. The outdoor kickball billiards gaming apparatus of claim 5 wherein plurality of balls includes a cue ball and a plurality of game balls.

* * * * *